US005517292A

United States Patent [19]

Yajima et al.

[11] Patent Number: 5,517,292

[45] Date of Patent: May 14, 1996

[54] FUSING APPARATUS HAVING A PAPER SEPARATING UNIT

[75] Inventors: Hiroyuki Yajima; Takashi Itaya, both of Tokyo, Japan

[73] Assignee: Oki Electric Industry Co., Ltd., Tokyo, Japan

[21] Appl. No.: 250,779

[22] Filed: May 27, 1994

[30] Foreign Application Priority Data

Jun. 1, 1993 [JP] Japan ..... 5-130172

[51] Int. Cl.[6] ..... G03G 15/20

[52] U.S. Cl. ..... 355/285; 271/900; 355/315

[58] Field of Search ..... 355/282, 285, 355/290, 315, 286–289, 291, 295; 219/216, 469–471; 271/307, 308, 310, 311, 313, 188, 273, 900

[56] References Cited

U.S. PATENT DOCUMENTS

| | | | |
|---|---|---|---|
| 3,998,584 | 12/1976 | Wada et al. | 219/216 X |
| 4,035,140 | 7/1977 | Tsuda et al. | 271/900 X |
| 4,060,320 | 11/1977 | Doi et al. | 271/308 X |
| 4,261,560 | 4/1981 | Yanagawa et al. . | |
| 4,401,382 | 8/1983 | Minejima et al. | 271/313 X |
| 4,571,056 | 2/1986 | Tani et al. | 355/290 |
| 4,761,667 | 8/1988 | Miyai et al. | 271/311 X |
| 4,806,966 | 2/1989 | Suga | 355/315 |
| 4,929,983 | 5/1990 | Barton et al. | 355/315 |
| 5,098,627 | 3/1992 | Yoshikawa et al. | 271/311 X |
| 5,285,245 | 2/1994 | Goto et al. | 355/282 X |
| 5,315,359 | 5/1994 | Nishikawa | 355/315 |

FOREIGN PATENT DOCUMENTS

| | | | |
|---|---|---|---|
| 431617A2 | 12/1990 | European Pat. Off. . | |
| 431617 | 6/1991 | European Pat. Off. . | |
| 57-82872 | 5/1982 | Japan | 355/315 |
| 57-161876 | 10/1982 | Japan | 355/315 |
| 59-37572 | 2/1984 | Japan . | |
| 59-38776 | 3/1984 | Japan | 355/315 |
| 60-189781 | 9/1985 | Japan | 355/315 |
| 62-283374 | 12/1987 | Japan | 355/315 |
| 1-081980 | 3/1989 | Japan | 271/900 |
| 1-231079 | 9/1989 | Japan | 355/282 |
| 2-183287 | 7/1990 | Japan | 355/315 |
| 3-144680 | 6/1991 | Japan | 355/315 |
| 3-130789 | 6/1991 | Japan | 355/315 |
| 4-170567 | 6/1992 | Japan | 355/290 |
| 1417443 | 12/1975 | United Kingdom . | |
| 1456237 | 11/1976 | United Kingdom . | |
| 2093437 | 9/1982 | United Kingdom . | |

*Primary Examiner*—A. T. Grimley
*Assistant Examiner*—Shuk Y. Lee
*Attorney, Agent, or Firm*—Law Office of Steven M. Rabin

[57] ABSTRACT

A fusing apparatus 14 for fusing toner onto paper includes a heater roller 2 and a separating unit 15 with a separation claw 16. The separation claw 16 is provided with a paper guide member 17 having a curvature in a direction opposite to the curvature from a point a to a point c on the heater roller 2. After fusing, the front end 10*a* of the separated paper 10 is guided by the paper guide member 17. The paper guide member 17 reforms a curl imparted by the heating roller 2 curl into the original state, even if the paper 10 sticks to the heater roller 2 until the point c.

19 Claims, 6 Drawing Sheets

FUSING APPARATUS HAVING A PAPER SEPARATING UNIT

CROSS-REFERENCE TO RELATED APPLICATIONS

This application claims the priority right under 35 USC 119 of Japanese Application No. Hei 05-130172 filed on Jun. 1, 1993, the entire disclosure of which is incorporated herein by reference.

BACKGROUND OF THE INVENTION

1. Field of the Invention

The present invention relates to a fusing apparatus, and more particularly, to a fusing apparatus for fusing a toner picture image onto a printing medium.

2. Description of the Related Art

A fusing apparatus (utilized in, for example, an electrophotographic printer or a copier) employs a rotatable heater roller, a rotatable back-up roller pressed to the heater roller and a plurality of movable separation claws attached in a direction parallel to the axis of the heater roller. The front end of each of the separation claws is pressed by an actuating member such as a compression spring to the peripheral surface of the heater roller. The position where the front end of a separation claw is pressed to the heater roller is located a little downstream from the position where the heater roller is pressed to the back-up roller.

When paper is transferred between the heater roller and the back-up roller, unfused toner adhered to the paper is melted and becomes highly viscous due to the heat of the heater roller and therefore fuses to the paper. When the paper is transferred to the position where the front ends of the separation claws are pressed to the heater roller, with the paper being stuck to the heater roller due to the viscosity of the toner, the paper is stripped off from the heater roller by the separation claws.

When the paper stuck to the heater roller is stripped off by the separation claws in the conventional fusing apparatus, the paper has been curled, since the curvature of the heater roller is preserved in the paper after stripping due to the adhesion of the paper to the heater roller. The conventional fusing apparatus is not equipped with correction members to reform the curl of the paper into the original state, so it is difficult to stack up plural sheets of paper in alignment with each other after printing, because the paper retains the curled state without returning to the original state when the toner is cooled down and solidified. Moreover, the conditions for stacking paper with a paper stacker become aggravated. Further, problems may arise during double faced printing. When a curled paper, one face of which is already printed but not the other face, is retransmitted to a printing unit for printing on the other face, paper feeding may be hindered in the paper transfer paths, which causes paper jams. Accordingly, the adhesion of the paper to the heater roller has been prevented by adjusting the cohesive force (Ft) of the toner to be larger than the adhesive force (Frt) of the toner to the heater roller, and by adjusting the adhesive force (Ftp) of the toner to the paper to be larger than the cohesive force (Ft), that is, $Frt<Ft<Ftp$. However, it has not previously been possible to strip the paper completely from the heater roller regardless of the paper utilized and to prevent the curl resulting from the application of heating or pressure due to the fusing conditions (temperature, pressure and heating time), toner ingredients (degradation of toner) or the lapse of time.

The above described technology is disclosed, for example, in Japanese Patent Laid-open Publication No. 59-34572.

SUMMARY OF THE INVENTION

It is the primary object of the present invention to provide a fusing apparatus which prevents a curl of the paper from resulting from heating or pressure during the fusing operation.

Another object of the present invention is to provide a fusing apparatus which reforms a curl of the paper resulting from the fusing operation into its original state.

The above objects can be accomplished by providing a fusing apparatus having: (i) a heater roller for thermally fusing an unfused toner adhered to a recording medium to the recording medium; and (ii) a separation claw, a front end of which is pressed to the heater roller, for stripping the recording medium from the heater roller by the front end; the separation claw further comprising a guide member for the recording medium having a curvature in an opposite direction to a curvature which is formed on the heater roller from a fusing portion thereof to the front end of the separation claw.

According to the another aspect of the present invention, there is provided a fusing apparatus having: (i) a heater roller for thermally fusing an unfused toner adhered to a recording medium to the recording medium; and (ii) a separation claw, a front end of which is pressed to the heater roller, for stripping the recording medium from the heater roller by the front end; wherein the separation claw further has the guide member having a movable member for evading an impact force from a front end of the conveyed recording medium.

According to the another aspect of the present invention, there is provided a fusing apparatus having: (i) a heater roller for thermally fusing an unfused toner adhered to a recording medium to the recording medium; and (ii) a separation claw, a front end of which is pressed to the heater roller, for stripping the recording medium from the heater roller by the front end; the separation claw having a movable member on a front end thereof for evading an impact force from a front end of the recording medium.

Still another aspect of the present invention can be realized by providing a fusing apparatus having: (i) a heater roller for thermally fusing an unfused toner adhered to a recording medium to the recording medium; and (ii) a separation claw, a front end of which is pressed to the heater roller, for stripping the recording medium from the heater roller by the front end; the separation claw having a movable member on a rear end or a front end thereof for evading an impact force from a front end of the recording medium.

According to the present invention, when a paper adhering to the heater roller after fusing is stripped or separated by the separation claw, the paper is transferred with the opposite curvature to that of the heater roller by the paper guide unit of the separation claw before the toner is cooled down and solidified.

Accordingly, even if a curl is impressed on the paper due to adhesion of the paper to the heater roller, the curvature of the paper guide unit of the separation claw can reform the curl into the original state.

DETAILED DESCRIPTION OF THE PREFERRED EMBODIMENTS

Figure 1:
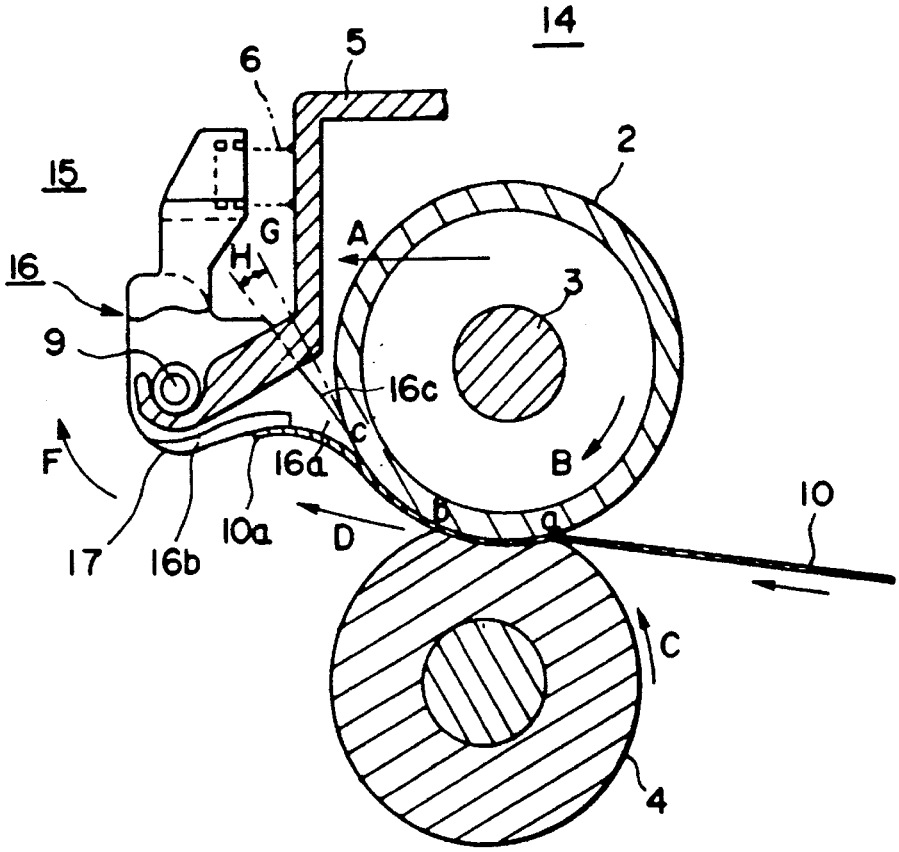
FIG. 1 is a schematic side view illustrating a fusing apparatus according to the first embodiment of the present invention.

A detailed explanation will be made as to embodiments of a fusing apparatus according to the present invention with reference to the appended drawings. The fusing apparatus of the embodiments can be applied to a device such as an electrophotographic printer, a copier, a plain paper facsimile or the like which incorporates a printing mechanism therein to fuse a toner picture image onto a printing medium. In the drawings, like reference characters denote like parts in the various views.

First Embodiment

Figure 2:
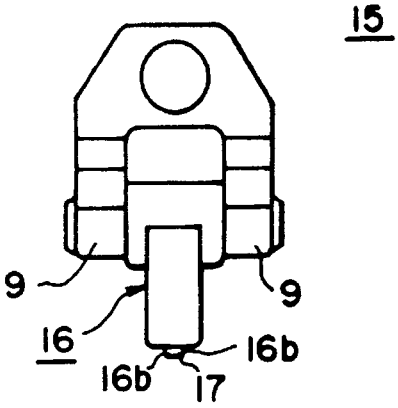
FIG. 2 is a front view illustrating a separating unit utilized in the first embodiment.

FIG. 1 is a schematic side view illustrating a fusing apparatus according to the first embodiment of the present invention, and FIG. 2 is a front view illustrating a separating unit utilized in the first embodiment as viewed from the direction shown by an arrow A in FIG. 1.

In FIG. 1, a heater roller 2 contained in a fusing apparatus 14 employs a heater 3 at its center and is pressed to a back-up roller 4. The heater roller 2 is constituted by a metallic pipe made from aluminum, stainless or the like and its surface is covered with a slippery material such as fluoric resin, silicone rubber or the like. This is because the heated heater roller 2 touches an unfused toner image directly, so that the heater roller 2 must have a sufficient removal characteristic (removability) against the toner. The back-up roller 4 is made from silicone rubber having a low hardness. Accordingly, the contact between the heater roller 2 and the back-up roller 4 forms a nip zone, between a point a and a point b, where the unfused toner is fused to paper.

A fusing unit cover 5 of the fusing apparatus 14 supports a separating unit 15 which is engaged by a compression spring 6. The separating unit 15 has a separation claw 16, the front end 16*a* of which is pressed against the heater roller 2 at a point c, and a supporting member 9 which is rotatably supported by the fusing unit cover 5. The separation claw 16 is used to strip off paper 10, which is adhered to the heater roller 2, from the heater roller 2. Plural numbers, usually four to six, of the separation claws 16 are disposed along an axial direction depending on the size of the paper that can be accepted for printing.

A paper guide member 17 is formed in the separation claw 16 at the side facing the paper 10. The paper guide member 17 has a curvature opposite to that of the zone between the point a and the point c on the heater roller 2.

A chamfering face member 16*b* shown in FIG. 2 is formed in the paper guide member 17 to relax the feeding resistance of the paper 10.

The front end 16*a* of the separation claw 16 is pressed to contact with the heater roller 2 with an appropriate pressure supplied by the compression spring 6.

An angle H between a line G tangent to the heater roller 2 at the point c and an opposing face 16*c* of the separation claw 16 facing the heater roller 2 is determined in such a manner that the front end 16*a* is pressed to the heater roller 2, to a degree such that it does not bite thereinto but efficiently separates the paper 10. The front end 16*a* is formed to have an arc having less than 0.05 mm in radius so as to prevent the heater roller 2 from becoming damaged and to separate the paper 10 securely from the heater roller 2 without rolling the paper 10 thereinto.

The separation claw 16 is made from a plastic such as liquid crystalline polymer, polyimide or the like which has excellent mechanical strength and heat resistance (hard to be deformed by high temperature). The front end 16*a* and the paper guide member 17 (or the entire surface of the separation claw 16) are covered with fluoric resin which is slippery and does not cause damage to the heater roller 2. It is also applied to the surface of the heater roller 2.

The fusing operation of the fusing apparatus 14 constructed as described above will now be explained referring to FIGS. 1 and 2.

First, the heater roller 2 is rotated in the direction shown an arrow B by turning on a power switch of the main device (not shown). The back-up roller 4 rotates in the direction shown by an arrow C in response to the rotation of the heater roller 2. When the paper 10, on which a toner picture image has been deposited, is transferred to the fusing apparatus 14 by a transfer roller (not shown), the paper 10 is sandwiched at the nip zone (a–b) between the heater roller 2 and the back-up roller 4. The toner is melted and becomes viscous due to heat from the heater roller 2. The melted toner fuses to the paper 10 and moreover is apt to adhere to the heater roller 2. However, the heater roller 2 has a removability property which normally prevents the paper 10 from sticking to it, causing the paper 10 at the end of the fusing operation to be stripped off the heater roller 2 at the point b shown in FIG. 1 and transferred in the direction illustrated with an arrow D by a combination of the feeding force of the heater roller 2 and the back-up roller 4. Then, the paper 10 is carried out from the fusing apparatus 14 into an eject roller unit (not shown). However, if a picture image with a high percentage of black is fused to a paper 10 having a highly smooth surface, a low thickness, and weak elasticity, or if the removability property of the heater roller 2 has deteriorated, the adhesive force of the toner on the paper 10 to the heater roller 2 becomes greater than normal so that the paper 10 cannot easily be stripped off from the heater roller 2 after fusing. Since both the heater roller 2 and the back-up roller 4 are rotating, the paper 10 is transferred to the point c with the paper 10 being stuck to the heater roller 2, and separated at the point c by the separation claw 16. The paper 10 separated from the heater roller 2 remains curled as a result of its adhesion to the heater roller 2. The front end 10*a* of the paper 10 is fed along the paper guide member 17, which is curved in a direction opposite to the curl of the paper 10, by feeding forces of the heater roller 2 and the back-up roller 4.

Since the toner on the paper 10 is not completely solidified at this moment, the paper 10 is transferred to the eject roller unit (not shown) with the curl reformed into the original state.

The above described embodiment reforms the curl of the paper 10 after fusing by guiding the paper 10 into the paper guide member 17, which has a curvature in a direction opposite to the curvature of the heater roller 2, before the toner is completely solidified.

Second Embodiment

Figure 3:
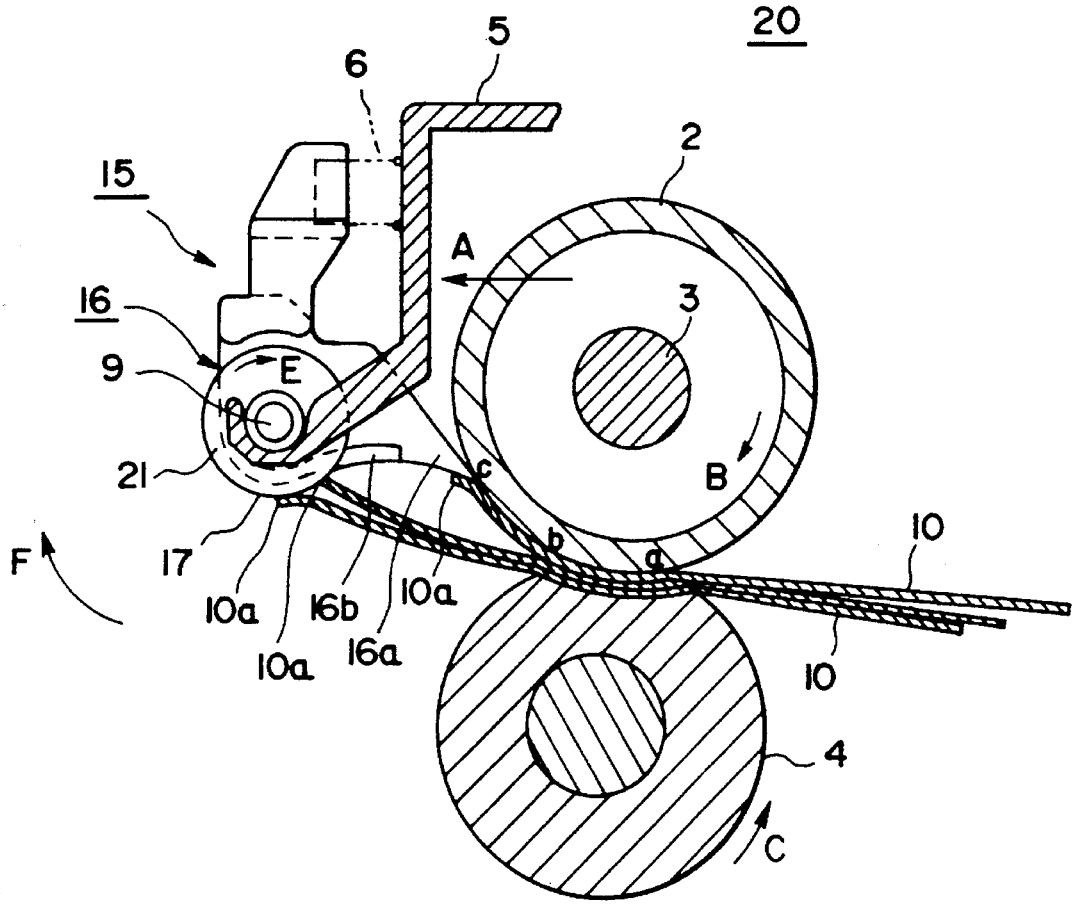
FIG. 3 is a schematic side view illustrating a fusing apparatus according to the second embodiment of the invention.
Figure 4:
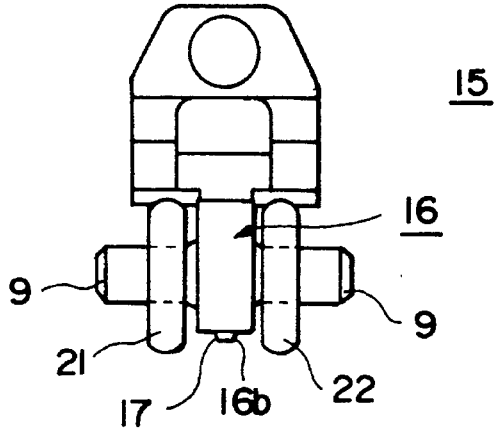
FIG. 4 is a front view illustrating a separating unit utilized in the second embodiment.

Next, the second embodiment according to the present invention will be explained hereinafter referring to FIGS. 3 and 4. FIG. 3 is a schematic side view illustrating a fusing apparatus according to the second embodiment of the present invention, and FIG. 4 is a front view illustrating a separation unit utilized in the second embodiment viewed from the direction shown by an arrow A in FIG. 3.

Rotatable members, rollers 21 and 22, are disposed on the supporting member 9 of the separating unit 15, which is employed in a fusing apparatus 20. The rollers 21 and 22 are located at the rear end of the paper feeding direction side, and an attached rotatably with their peripheral surfaces slightly protruding toward the back-up roller 4.

The rollers 21 and 22 are made from a plastic such as liquid crystalline polymer, polyimide or the like which has an excellent mechanical strength and a high heat resistance (hard to be deformed by high temperature), and their surfaces are covered with fluoric resin having high slipperyhess. The other structures are same as those shown in the first embodiment.

Now, the paper separating operation of the fusing apparatus according to the second embodiment will be explained referring to FIGS. 3 and 4. Since this embodiment operates the same as the first embodiment if the paper 10 does not adhere to the heater roller 2 after fusing or if a single sheet of the paper 10 adheres to the heater roller 2 after fusing, an explanation of these situations will be omitted. Accordingly, only the paper separating operation when multiple sheets of paper are conveyed simultaneously will be explained hereinafter.

After fusing, if a first sheet of paper 10 is stuck to the heater roller 10 and fed to the point c and if successive sheets of paper 10 happen to be fed duplicately by the feeding forces of the heater roller 2 and the back-up roller 4, the front ends 10*a* of the successive sheets stick the rollers 21 and 22 because the rear end of the separation claw 16 protrudes toward the upper sides of the successive sheets of paper 10 and the rollers 21 and 22 are formed to protrude further from the rear end. If the rollers 21 and 22 did not exist, when the successive sheets of paper 10 strike the rear end of the separation claw 16, the impact force would become large enough to rotate the separation claw 16 in the direction shown with an arrow F so that the front end 16*a* would be removed from the heater roller 2. However, since the rotating rollers 21 and 22 feed the successive sheets into an eject roller unit (not shown), the front end 16*a* of the separation claw 16 does not move from the heater roller 2.

The first sheet is removed from the heater roller 2 by the front end 16*a* of the separation claw 16 and guided by the paper guide member 17. Although the leading edge of the paper strikes the rollers 21 and 22, the paper 10 is fed to the eject roller unit (not shown) by rotating the rollers 21 and 22 with its feeding force. Furthermore, the first sheet of the paper 10 is curled due to its adhesion to the heater roller 2, but it is fed in the opposite direction by the paper guide member 17 so that the curl is reformed in the same way as in the first embodiment.

If multiple sheets of paper 10 are transferred in the second embodiment and the front ends 10*a* strike the rear end of the paper guide member 17, the impact force of the front ends 10*a* is evaded because the rollers 21 and 22 are rotated by the front ends 10*a* so that the separation claw 16 is never rotated in the direction F by the impact force.

Accordingly, there never occurs a paper jam caused by a front end 10*a* striking and rotating the separation claw 16, thereby releasing the contact of the front end 16*a* of the separation claw 16 with the heater roller and permitting the first sheet of the paper 10 to roll between the heater roller 2 and the separation claw 16.

As a result, a paper 10 which is stuck to the heater roller 2 can be removed more securely than was the case with the first embodiment. Although the second embodiment employs rollers 21 and 22 at both sides of the separation claw 16, a single roller can be used at one side only of a respective separation claw if a plurality of separation claws, approximately four to six, for example, have been provided along an axial direction.

Further, although the second embodiment relaxes the feeding resistance of the paper 10 by employing the rotatable rollers 21 and 22, it is not restricted to the use of rollers 21 and 22 to relax the feeding resistance. A lever, for example, which can evade the impact force of the front end 10*a* of the paper 10 in the paper feeding direction, can alternatively be utilized. In this case, the lever also needs to be covered with slippery fluoric resin as well as the rollers 21 and 22.

Figure 5:
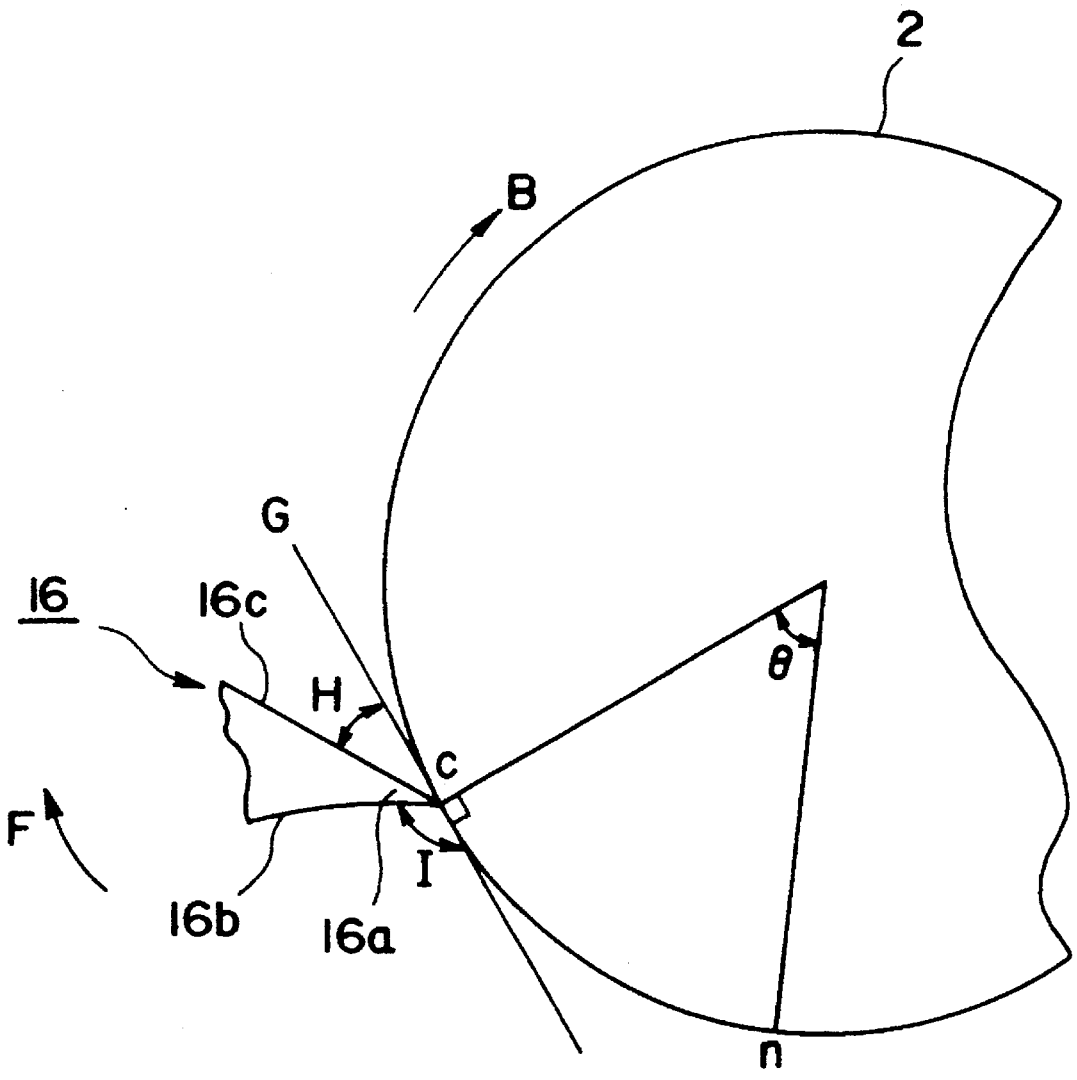
FIG. 5 is an explanatory view illustrating a contact state of a separation claw according to one variation of the second embodiment.

A modified example of the second embodiment will be further described referring to FIG. 5 and Table 1 in addition. FIG. 5 is an explanatory view illustrating a separation claw according to one variation of the second embodiment in a state of contact with the roller 2. Table 1 shows the results of an experimental investigation into the occurrence of paper stain.

In the modified example, the width of a separation claw 16 as shown in FIGS. 3 and 5 is set to be small, for example, approximately in the range of 1–1.2 mm. The angle θ is the angle of a circular arc extending from the center point n between the points a and b to the point c. The angle θ is set to be approximately in a range of 40°– 55°. The angle H is defined as the angle formed by a line G which is tangent to the heater roller 2 at the point c and the opposing surface 16*c* of the separation claw 16 which is opposite the heater roller 2.

Since the front end 16*a* of the separation claw 16 is pressed to the heater roller 2 in a manner so as not to bite thereinto and has an arced shape so as to separate the paper 10 effectively, residual molten toner stuck to the surface of the heater roller 2 reaches the opposing surface 16*c* of the separation claw 16 through a small gap at the point c. It may gradually be accumulated on the opposing surface 16*c*. When the weight of the molten toner accumulated is more than enough to exceed its surface tension, it is transferred by the heater roller 2 to the nip zone, and may soil the front surface of the paper 10 or the back surface of the paper 10 if it sticks to the back-up roller 4. Table 1 shows the results of an experimental investigation into the relationship between the angle H and the occurrence of paper contamination where the width of the separation claw 16 is set to be 1.2 mm, the angle of the front end of the separation claw 16 is set to be 30°, the angle θ of the circular arc from the center point n between the points a and b to the point c is set to be 47.5°, and the number of the separation claws 16 along the axial direction of the heater roller 2 is set to be 5. According to the experimental results shown in Table 1, the larger the angle H becomes, the fewer and the lighter the stains on the paper 10 become. Accordingly, a favorable result as to paper stain or contamination can be achieved when the angle H exceeds 23°.

TABLE 1

| Angle H | Angle I | Maximum Level of Paper Stain |
|---|---|---|
| 8° | 142° | 5 |
| 16° | 134° | 4 or 3 |
| 23° | 127° | 2 |
| 30° | 120° | 1 |
| 35° | 115° | 1 |

(Note)
Level 1; Light and small at one place, or Light and inconspicuous at two or three places;
Level 2; Dark (or light) and large at one place, or Dark and small at one place, or Light and small at two or three places;
Level 3; Dark and small (or light and large) at two or three places, or Light and small at four or five places;
Level 4; Dark and small at four or five places, or Dark and large at two or three places;
Level 5; Dark (or light) and large (Long) at four or five places.

The accumulated residual toner may cause the front end 16*a* of the separation claw 16 to press only partially against the heater roller 2, which might result in damage to the heater roller 2 and insufficient paper removal from the heater roller 2. However, the line pressure of the front end 16*a* to the heater roller 2 can be maintained at a constant value, so that such partial contact of the front end 16*a* does not occur, by making the claw width of the separation claw 16 small. This makes it difficult for the toner to accumulate on the opposing surface 16*c*.

Accordingly, early wear and damage to the heater roller 2 can be prevented.

Further, the experiment shows that if the front end 16*a* of the separation claw 16 is covered with PFA (Polytetrafluoroethylene.Parfluoroalkylvinylether copolymer resin), which is more slippery than PTFE (Polytetrafluoroethylene resin) among the fluoric resins, staining or contamination on the front or back surface of the paper 10 due to toner on the opposing surface 16*c* of the front end 16*a* is decreased, along with early wear and damage to the heater roller 2. PTFE can be replaced by ETFE (Polytetrafluoroethylene-.Ethylene Copolymer resin).

The larger the angle H becomes, the smaller the angle I between the tangential line G and the paper guide member 17 becomes, so that the paper feeding resistance due to contact of the leading part of the paper against the rollers 21 and 22 increases. However, the front end 16*a* does not rotate in the direction of arrow F because the paper feeding resistance is relaxed by the rollers 21 and 22 being rotated with the front end 10*a* contacting with the rollers 21 and 22 disposed at the separation claw 16. However, if the angle I decreases to or below 90°, the paper feeding resistance increases due to the contact of the front end 10*a* of the paper 10, which causes a paper jam. Accordingly, the angle H is preferably set to be in a range of 23°–40°.

Third Embodiment

Figure 6:
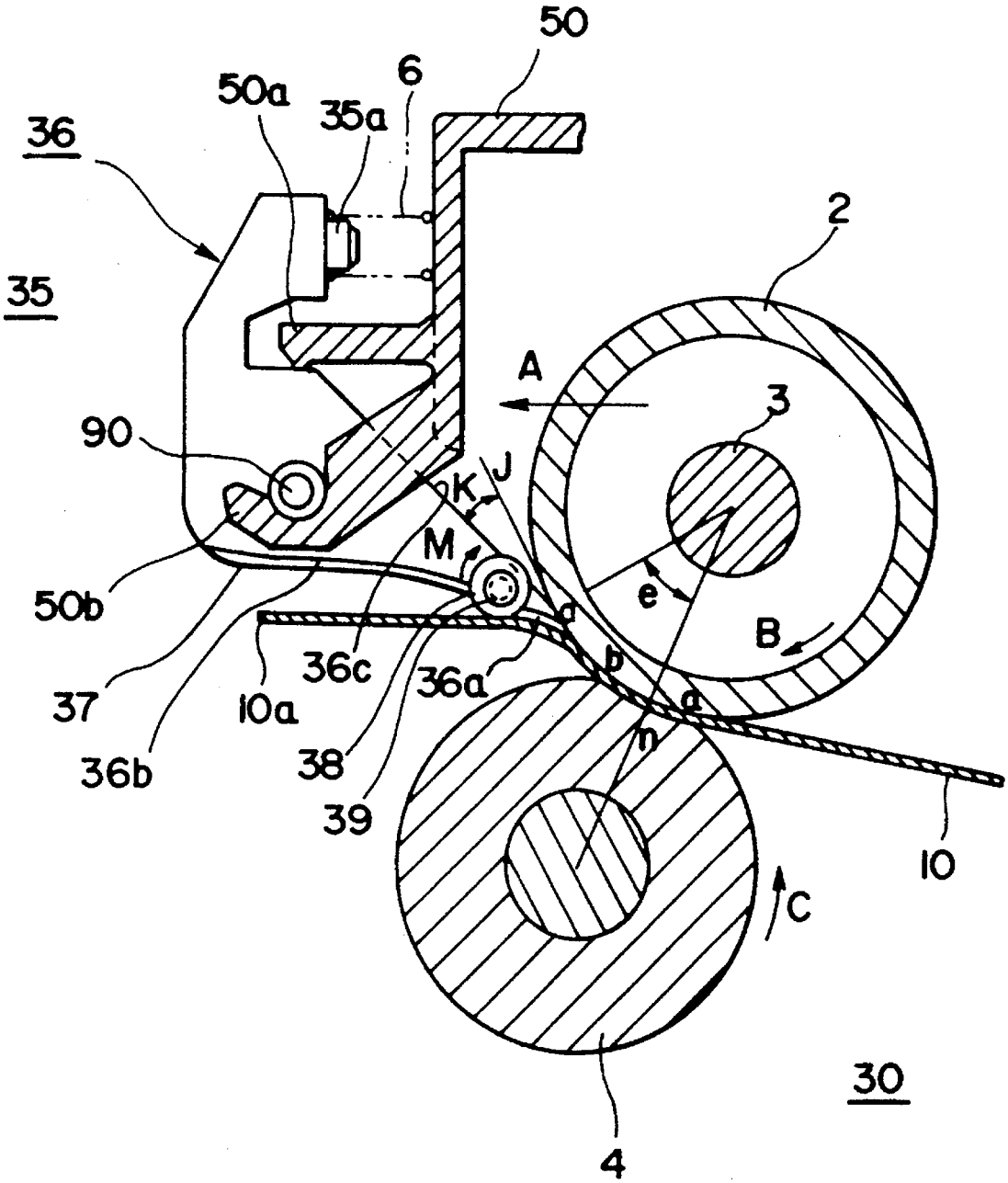
FIG. 6 is a schematic side view illustrating a fusing apparatus according to the third embodiment of the present invention.
Figure 7:
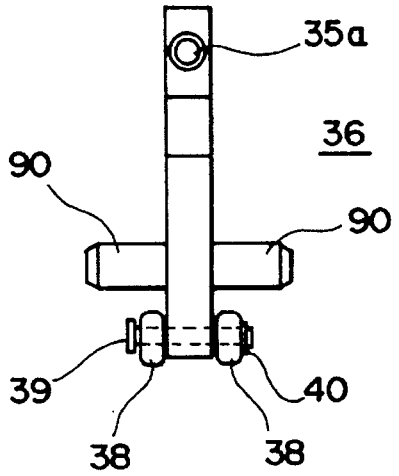
FIG. 7 is a front view illustrating a separating unit utilized in the third embodiments.

The third embodiment will now be described referring to FIGS. 6 and 7 and Table 2. FIG. 6 is a schematic side view illustrating a fusing apparatus according to the third embodiment of the present invention; and FIG. 7 is a front view illustrating a separating unit viewed from the direction an arrow A shown in FIG. 6. The diameter of the heater roller 2 is set to be 28 mm in the third embodiment. Table 2 shows the results of an experiment which was conducted to find the occurrence of flaws on the printing surface when an entirely black picture image was printed.

TABLE 2

| Circle with an arc nd | Length of | Flaw Occurrence Status | |
|---|---|---|---|
| Arc Angle e | arc nd | No Rollers | Rollers |
| 57.8° | 14.1 | ○ | ○ |
| 50.0° | 12.2 | Δ | ○ |
| 44.6° | 10.9 | X | ○ |
| 37.3° | 9.1 | X | ○ |
| 25.0° | 6.1 | X | ○ |

(Note)
○: Flaws did not occur.
Δ: Flaws occurred without causing a paper jam.
X: Flaws occurred and caused a paper jam.

The center of the back-up roller 4 employed in the fusing apparatus 30 is disposed on a straight line connecting the center of the heater roller 2 with the center n of the nip zone (a–b). A fusing unit cover 50 has a latch member 50*a* and a holder member 50*b* which support a separating unit 35. The separating unit 35 is pressed against the surface of the heater roller 2 by a compression spring 6 which engages a spring boss member 35*a*. The separating unit 35 is constituted of a separation claw 36, the front end 36*a* of which is forced against the heater roller 2 at the point d of the heater roller 2, and a supporting member 90 rotatably supported by the fusing unit cover 50. The separation claw 36 is utilized to strip paper 10 adhering to the heater roller 2 from the heater roller 2. Separation claws 36 are disposed parallel to the axial direction of the heater roller 2. Plural numbers, such as four to six, are employed in accordance with the permissible paper size which can be printed. A paper guide member 37 at the bottom side of the separation claw 36 is slightly curved, the curvature being smaller than that of paper guide members of the first or second embodiment.

The paper guide member 37 also incorporates a chamfering face member 36*b* for relaxing the paper feeding resistance. The front end 36*a* of the separation claw 36 is pressed into contact with the heater roller 2 at the point d by the compression spring 6 with an appropriate pressure. The front end 36*a* has an arced shape less than 0.05 mm in radius to avoid damaging the heater roller 2 and to separate the paper 10 securely from the heater roller 2. The separation claw 36 is made of a plastic such as liquid crystalline polymer, polyimide or the like having excellent mechanical strength and heat resistance (hard to be deformed by high temperature). The front end 36*a* and the paper guide member 37 (or the entire surface of separation claw 36), along with the surface of the heater roller 2, are covered slippery fluoric resin to prevent injuring the heater roller 2. The angle K between a line J tangent to the heater roller 2 at a point d and an opposing surface 36*c* of the separation claw 36 is determined such that the front end 36*a* cannot bite into the heater roller 2 and can effectively separate the paper 10.

Two movable members, rollers 38, are rotatably attached to the front end of the paper guide member 37 in the paper feeding direction as shown in FIG. 7. The outer peripheral surface of each of the roller 38 protrudes slightly from the paper guide member 37. The rollers 38 are combined with a roller shaft 39 and are prevented from falling off by an E type fixture ring 40. Each roller 38 is made from a highly slippery fluoric resin. If PFA is selected as the fluoric resin, a coating on the surface of the roller 38 is unnecessary. Although the roller shaft 39 is usually attached to the separation claw 36 afterwards, it can be molded with the separation claw 36, the rollers 38 being mounted thereafter onto the integrated roller shaft 39. The other structures are similar to those of the first embodiment.

If the contact point d of the front end 36*a* of the separation claw 36 approaches to the point b and the paper 10 is separated from the heater roller 2 before the curl is preserved on the paper 10, the curl generated by the paper 10 being stuck to the heater roller 2 can be avoided. However, since a peeling off force by which the paper 10 tends to peel itself off from the heater roller 2 is determined by the removability property of the heater roller 2 and the elasticity of the paper 10 and becomes larger as the distance between the points b and d increases, and since the adhesive force by which the paper 10 sticks to the heater roller 2 becomes larger as the distance between the points b and d decreases, if the distance between points b and d is shortened before the paper 10 is stripped from the heater roller 2, the pressure of the front end 10*a* against the paper guide member 37 (i.e. the paper feeding resistance) increases, which may generate flaws on the printing surface.

Since the rollers 38 are provided at the front end 36*a*, the front end 10*a* of the paper 10 is pressed into contact with the rollers 38, which reduce the paper feeding resistance so that the point d, as shown in Table 2, can be moved nearer to the point b.

The paper separating operation for the third embodiment will now be explained. Since the fusing operation and the situation in which the paper 10 does not adhere to the heater roller 2 are similar to those in the first or second embodiment, further explanation will be omitted.

If the paper 10 has a highly smooth surface, a low thickness, and weak elasticity and a toner picture image with a high percentage of black is fused on such a paper 10, or if the removability property of the heater roller 2 has deteriorated, the adhesive force between the heater roller 2 and the paper 10 increases more than normal so that the paper 10 is not removed or stripped from the heater roller 10 after fusing. Since the heater roller 2 is rotating, the paper 10 is fed to the point d with the paper 10 sticking to the heater roller 2 and separated at the point d by the separation claw 16. The front end 10*a* of the separated paper 10 strikes the rollers 38 and rotates the rollers 38 in the direction of an arrow M so that the paper feeding resistance can be relaxed. Thereafter, the paper 10 is guided by the rollers 38 and transferred to the eject roller unit (not shown). According to the third embodiment, since the separation claw 36 strips the paper 10 from the heater roller 2 before a curl is preserved on the paper even though the paper 10 is stuck to the heater roller 2, the curl is not retained on the paper 10.

Figure 8:
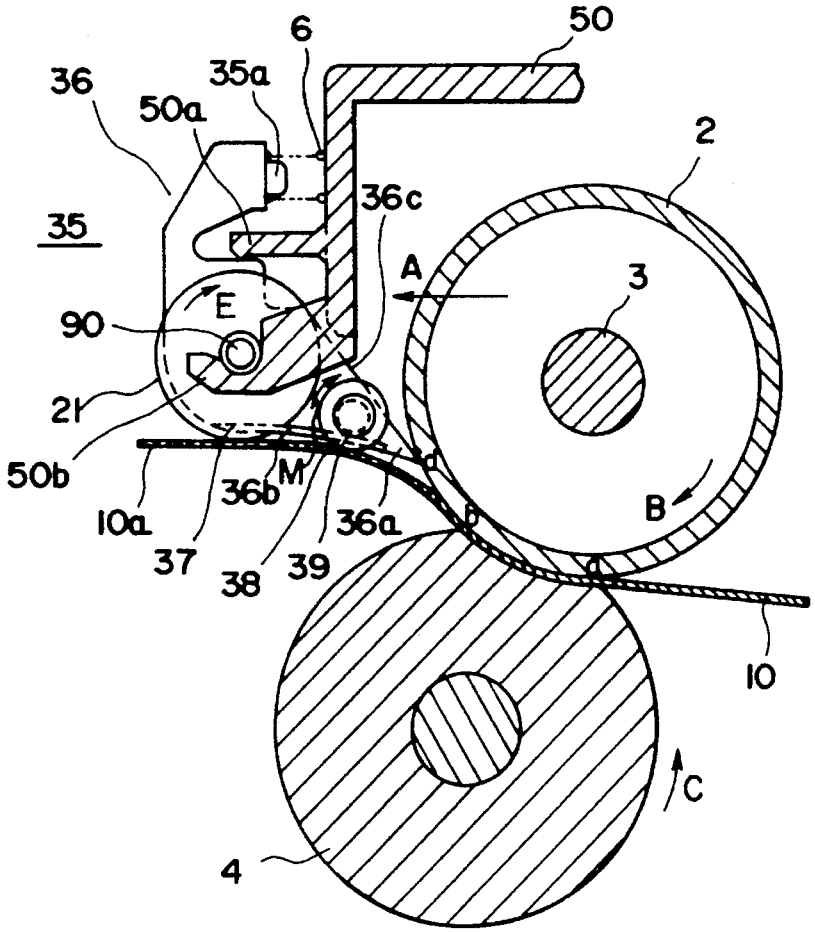
FIG. 8 is a schematic side view illustrating a fusing apparatus according to one variation of the third embodiment.
Figure 9:
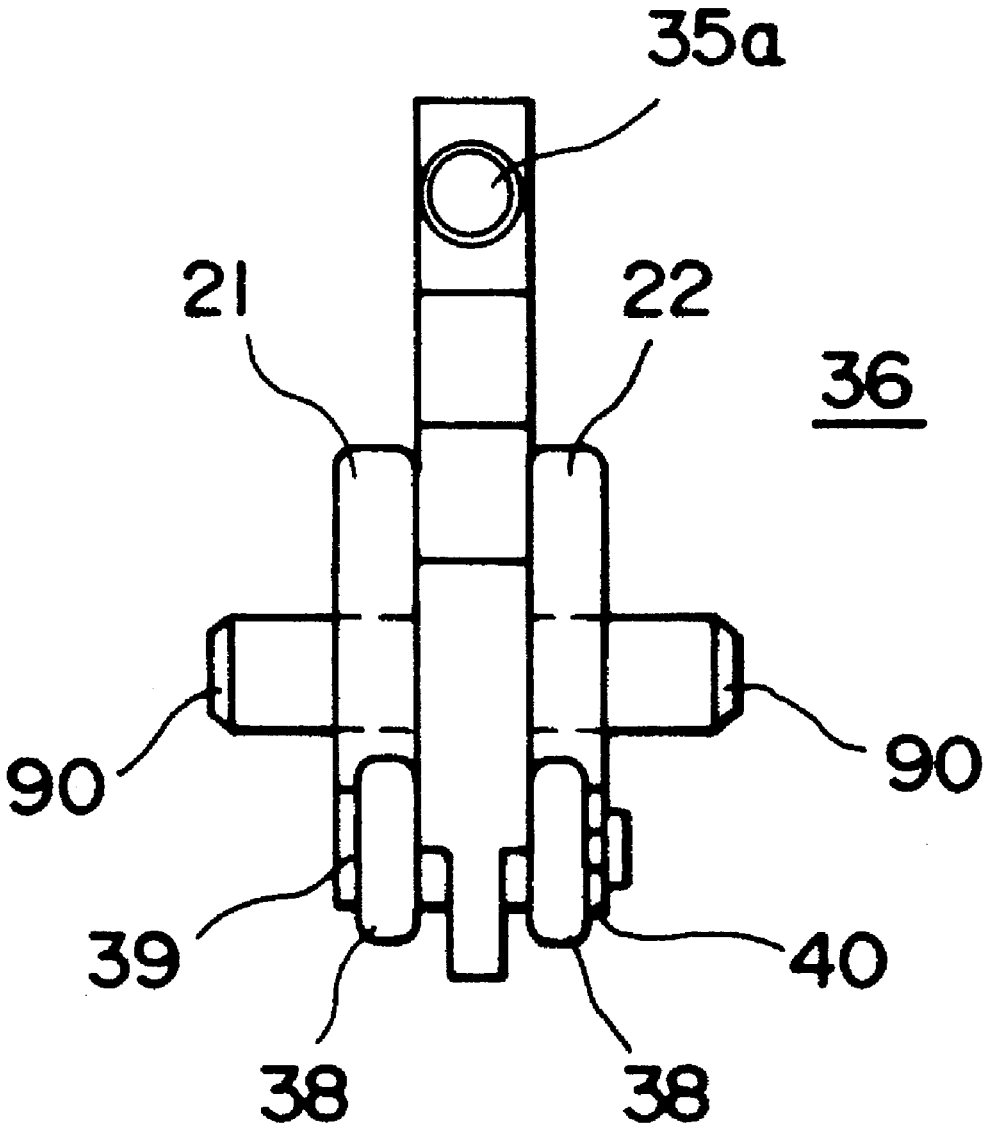
FIG. 9 is a front view illustrating a separating unit utilized in one variation of the third embodiment.

Also, the paper feeding resistance of the front end 10*a* of the paper 10 is relaxed by the rollers 38 so that no flaws occur on the printing surface. Since the paper 10 is removed from the heater roller 2 prior to preservation of a curl in the third embodiment, the front end 10*a* of the paper does not collide with the rear end of the paper guide member 37 in the paper feeding direction. However, if it happens, rollers whose outer peripheral surfaces protrude slightly from the paper guide member 37 as shown in FIGS. 8 and 9 may be rotatably attached to the supporting member 90. Although rollers are provided at both sides of the separation claw in the third embodiment, a single roller for each separation claw can be employed at one side thereof if plural numbers (four to six) of the separation claws are disposed parallel to the axial direction of the heater roller.

Although the paper guide member 37 employed in the separation claw 36 according to the third embodiment has a shape that is slightly curved, a straight line shaped member can also provide similar advantages and effects to the third embodiment.

In the third embodiment, the back-up roller 4 approaches the separation claw 36 rather than being located beneath the heater roller 2. This is because the paper 10 can be transferred more smoothly along the paper feeding route if the paper 10 is transferred from the fusing unit in an upward direction rather than in a horizontal direction, since the paper feeding route (not shown) is so constructed that the paper 10 is moved to a stacker disposed at the upper portion of the apparatus after it passes through the fusing unit. Since the paper 10 is transferred along the separation claw 36 after passing through the fusing unit, the curvature of the paper 10 can be securely reformed. If the back-up roller 4 is arranged in the manner described above, effects similar to those achieved in the first or second embodiment can be obtained.

As described above in detail, since the present invention provides a separation claw having a paper guide member with a curvature opposite to that of the heater roller, which tends to impress its curvature on the paper after fusing, the paper guide member guides the paper in a direction opposite to the curl of the paper, so that the curl is reformed into the original state. Since the present invention also provides a rotatable roller which is mounted on the separation claw and which protrudes slightly toward the opposing side therefrom, the curl resulting from adhesion of the paper to the heater roller after fusing can be not only reformed, but also the impact force of the front end of the paper against the paper guide member can be evaded.

Accordingly, no gap is generated between the front end of the separation claw and the heater roller due to a collision with the front end of the paper.

As a result, no flaws are generated on the toner picture image after fusing and the curl reformation can be securely realized.

What is claimed is:

1. A fusing apparatus, comprising:

a heater roller having a fusing portion for thermally fusing toner to a first recording medium which is fed to the heater roller, the fusing portion having a predetermined curvature; and a separating unit which includes a separation claw having a front end portion and a rear end portion, the front end portion being pressed to the heater roller to strip the first recording medium from the heater roller, the separation claw additionally having a guide member for guiding the first recording medium after it has been stripped from the heater roller, the guide member having a curvature in a direction opposite to the curvature of the fusing portion of the heater roller, and a rotatable member for engaging a second recording medium if such a second recording medium is fed along with the first recording medium, such a second recording medium having a front end and advancing in a direction toward the rear end portion of the separation claw, the rotatable member being mounted on the separation claw and protruding slightly from the guide member to evade an impact force from the front end of such a second recording medium.

2. A fusing apparatus as set forth in claim 1, wherein the rotatable member is a freely rotatable roller.

3. A fusing apparatus as set forth in claim 2, wherein the separation claw further comprises a supporting member which extends from the rear end portion of the separation claw and which defines a pivot axis that runs through the rear end portion, and wherein the rotatable member is disposed on the supporting member and near the rear end portion of the separation claw.

4. A fusing apparatus as set forth in claim 3, wherein the rotatable member on the separation claw is made from a plastic having high mechanical strength and high heat resistance, and has a surface which is covered with a slippery fluoric resin.

5. A fusing apparatus as set forth in claim 2, wherein the front end portion of the separation claw and the guide member thereof are covered with Polytetrafluoroethylene.Parfluoroalkylvinylether copolymer resin.

6. A fusing apparatus as set forth in claim 2, further comprising a fusing unit cover having a portion which covers at least part of the heater roller and having another portion which is configured as a holder member having a recess, and wherein the separation claw further comprises a supporting member which extends into the recess of the holder member to mount the separation claw and provide a pivot axis which extends through the supporting member, and wherein the rotatable member for engaging the second recording medium is disposed coaxially with respect to the supporting member.

7. A fusing apparatus, comprising:

a heater roller having a fusing portion for thermally fusing toner to a recording medium which is fed to the heater roller, the recording medium having a front end; and a separating unit which includes a separation claw which is supported at a pivot axis and which has a front end portion that is pressed to the heater roller in the vicinity of the fusing portion to strip the recording medium from the heater roller before a curl induced by the heater roller is preserved on the recording medium, a shaft mounted on the separation claw near the front end portion thereof, the shaft having an axis which is parallel to the pivot axis and which is closer than the pivot axis to the front end portion, and a rotatable member, which is mounted on the shaft and which has a portion that protrudes slightly from the separation claw, for evading an impact force from the front end of the recording medium.

8. A fusing apparatus as set forth in claim 7, wherein the rotatable member is a roller.

9. A fusing apparatus as set forth in claim 8, wherein the roller comprises slippery fluoric resin.

10. A fusing apparatus as set forth in claim 7, wherein the fusing portion of the heater roller has a middle position, wherein the heater roller has an axis, and wherein a line between the middle position of the fusing portion and the axis of the heater roller is disposed at an angle to a line between the axis of the heater roller and the position where the front end portion of the separation claw is pressed to the heater roller, the angle being no greater than 45°.

11. The fusing apparatus of claim 10, wherein the angle is less than about 37°.

12. The fusing apparatus of claim 10, wherein the angle is less than about 25°.

13. A fusing apparatus, comprising:

a heater roller having a fusing portion for thermally fusing toner to a recording medium which is fed to the heater roller, the recording medium having a front end; and a separating unit which includes a separation claw having a rear end portion and having a front end portion which is pressed to the heater roller in the vicinity of the fusing portion to strip the recording medium from the heater roller before a curl induced by the heater roller is preserved on the recording medium, a movable member which is mounted on the separation claw near the front end portion and which protrudes slightly past the separation claw for evading an impact force from the front end of the recording medium, and another movable member mounted on the separation claw near the read end portion.

14. A fusing apparatus as set forth in claim 13, wherein the movable members comprise rollers which are rotatably mounted on the separation claw.

15. A fusing apparatus as set forth in claim 14, wherein the rollers have diameters that are substantially different.

16. A fusing apparatus, comprising:

a heater roller; and a separating unit which includes a separation claw having a front end portion, mounting means for mounting the separation claw so that it is pivotable about a pivot axis and so that its front end portion is biased against the heater roller, and a freely rotatable roller mounted on the separation claw at a position which is closer than the pivot axis to the front end portion.

17. The fusing apparatus of claim 16, wherein paper having toner on it is fed to the heater roller, wherein the heater roller melts the toner, and wherein the separation claw comprises uncurling means for relieving a curl impressed on the paper by the heater roller before the toner on the paper has entirely solidified, the uncurling means including a curved bottom surface on the separation claw.

18. The fusing apparatus of claim 16, further comprising a pressure roller which presses against the heater roller and which rotates about a pressure roller axis, and wherein the heater roller rotates about a heater roller axis, the front end portion of the separation claw contacts the heater roller at a contact point, and a line between the heater roller axis and the pressure roller axis diverges from a line between the contact point and the heater roller axis by an angle of less than about 45°.

19. A fusing apparatus comprising:

a plurality of rollers, the plurality of rollers including a heater roller and an impact-evasion roller, the heater roller having a fusing portion for thermally fusing toner to a first recording medium which is fed to the heater roller, the fusing portion having a predetermined curvature; and a separation claw having a front end portion and a rear end portion, the front end portion being pressed to the heater roller to strip the first recording medium from the heater roller, the separation claw additionally having a guide member for guiding the first recording medium after it has been stripped from the heater roller, the guide member having a curvature in a direction opposite to the curvature of the fusing portion of the heater roller;

wherein the impact-evasion roller is a freely rotatable roller which is mounted on the separation claw at a position to engage a second recording medium if such a second recording medium is fed along with the first recording medium, such a second recording medium having a front end and advancing in a direction toward the rear end portion of the separation claw, the impact-evasion roller protruding slightly from the guide member to evade an impact force from the front end of such a second recording medium; and wherein the first recording medium has a predetermined thickness, and the impact-evasion roller is spaced apart from every other roller in the fusing apparatus by a distance that is substantially greater than the thickness of the first recording medium.

* * * * *